United States Patent [19]

Basalyk et al.

[11] Patent Number: 4,600,443

[45] Date of Patent: Jul. 15, 1986

[54] PROCESS FOR REMOVING SURFACE OXIDES FROM A COPPER-BASE ALLOY

[75] Inventors: Peter I. Basalyk, Parma; Dorothy Lukco, Macedonia; J. Robert Mooney, South Russell; Dexter C. Seifert, Lyndhurst, all of Ohio

[73] Assignee: Kennecott Corporation, Cleveland, Ohio

[21] Appl. No.: 656,308

[22] Filed: Oct. 1, 1984

[51] Int. Cl.[4] ..... C23G 1/02; C23G 1/14

[52] U.S. Cl. ..... 134/3; 134/28; 134/29

[58] Field of Search ..... 134/2, 3, 28, 29, 41; 252/100, 101

[56] References Cited

U.S. PATENT DOCUMENTS

| | | | |
|---|---|---|---|
| 2,318,559 | 5/1943 | Percival | 134/41 X |
| 2,428,804 | 10/1947 | Terry et al. | 252/100 |
| 2,726,970 | 12/1955 | Toth | 134/3 |
| 3,162,547 | 12/1964 | Kendall | 134/3 |
| 3,274,114 | 9/1966 | Grof | 252/100 |
| 3,646,946 | 3/1972 | Ford et al. | 134/3 |
| 3,728,155 | 4/1973 | Ford et al. | 134/3 |
| 4,051,057 | 9/1977 | Ericson et al. | 134/3 X |
| 4,089,703 | 5/1978 | White | 134/22 |
| 4,361,445 | 11/1982 | Pryor et al. | 134/28 X |
| 4,510,018 | 4/1985 | McGowan | 134/3 X |

FOREIGN PATENT DOCUMENTS 2031468 4/1980 United Kingdom .

OTHER PUBLICATIONS

Penwalt Metalworking Memo.

*Primary Examiner*—Arthur L. Corbin

*Attorney, Agent, or Firm*—Gary R. Plotcher; Larry W. Evans

[57] ABSTRACT

Surface oxides, such as copper, zinc and aluminum oxides, are effectively removed from copper-base alloys by a process comprising:

(a) contacting the alloy surface with an aqueous solution containing potassium ions, e.g. a solution prepared by dissolving potassium hydroxide in water; and (b) subsequently contacting the alloy surface with an aqueous solution comprising an acid, a peroxide, and a metal oxide, e.g. a solution of sulfuric acid, hydrogen peroxide and molybdic acid, the solution having:

(i) an acid equivalent of a sulfuric acid solution of about 4 to 30 percent by volume;

(ii) a peroxide concentration of about 1 to 30 percent by volume; and (iii) a metal oxide concentration of about 0.1 to 5 percent by volume.

18 Claims, No Drawings

PROCESS FOR REMOVING SURFACE OXIDES FROM A COPPER-BASE ALLOY

BACKGROUND OF THE INVENTION

1. Field of the Invention

This invention relates to copper-base alloys. In one aspect, the invention relates to a method of removing surface oxides from a copper-base alloy while in another aspect, the invention relates to removing complex thermal oxides, particularly aluminum oxides, from the surface of aluminumcontaining copper-base alloys.

2. Description of the Prior Art

The art contains various references teaching different methods for removing surface oxides from copper-base alloys. Representative of these teachings are Toth, U.S. Pat. Nos. 2,726,970; Grof, 3,274,114; and Ford et al., 3,646,946.

Toth teaches a multi-step process comprising cleansing the copper-base alloy in an alkaline solution, rinsing the alloy in cold water followed by contacting the alloy with a solution of strong sulfuric and nitric acid, and then twice rinsing the alloy in cold running water. The alloy is finally immersed in a solution containing a thio compound, e.g. sodium thiosulfate, and oxyboron compound, e.g. sodium tetraborate, and a sulphonate, e.g. an alkyl aryl sulphonate.

Grof teaches the use of a composition that has both tarnish removing and tarnish inhibiting properties and which is particularly useful in connection with copper or copper-containing alloys. The composition consists essentially of 5–40 percent by weight of sulfamic acid, 5–40 percent by weight of either a hexavalent chromium salt or an anhydride of a hexavalent chromium compound, and water.

Ford et al. teach a process for removing surface oxides from copper alloys which consists of a duplex treatment requiring a first immersion in a hot alkaline solution followed by a second immersion in a hot mineral acid solution. The pH of the alkaline solution is between 10 and 14, preferably between 11 and 14 and is typically a solution of sodium hydroxide. The mineral acid solution has an acid equivalent to a sulfuric acid solution of 3–50 percent by volume and is preferably sulfuric acid. This method is taught to be useful for cleaning copper-base alloys which have been annealled-to-temper.

While these and other copper-base alloy cleaning processes all demonstrate utility, none are completely satisfactory. These processes leave considerable amounts of copper oxide on the surface of the alloys and where the alloys contain aluminum and zinc, considerable amounts of aluminum and zinc oxide are also left on the alloy surface. In addition, not all of these processes are amenable to cleaning a copper-base alloy moving through a production line and of those (e.g. U.S. Pat. No. 3,646,946) that are, none are entirely satisfactory in terms of overall efficiency, e.g. energy consumption, residence time, reagent consumption, etc.

SUMMARY OF THE INVENTION

According to this invention, surface oxides are efficiently removed from copper-base alloys by a process comprising:

(a) contacting the alloy surface with an aqueous solution comprising potassium ions; and (b) subsequently contacting the alloy surface with an aqueous solution comprising an acid, a peroxide, and a metal oxide, the solution having:

(i) an acid equivalent of a sulfuric acid solution of about 4 to 30 percent by volume;

(ii) a peroxide concentration of about 1 to 30 percent by volume; and (iii) a metal oxide concentration of about 0.1 to 5 percent by volume.

This invention is particularly useful for removing copper, aluminum and zinc oxides from a copper-base alloy in a production environment, e.g. cleaning copper-base sheet or wire prior to its removal from a production line.

DETAILED DESCRIPTION OF THE INVENTION

Copper-base Alloys

Essentially any copper-base alloy can be cleaned by the process of this invention. Copper-zinc alloys are particularly suited for this invention, especially those alloys also containing aluminum. The amount of the zinc and aluminum in the alloy can vary widely and is not particularly important to the practice of this invention. The alloy can contain other components as well, such as nickel, chromium, etc. This invention is particularly useful for removing surface oxides from alloys containing between about 50 to about 90 percent copper, between about 1 to about 45 percent zinc, and between about 0.1 to about 15 percent aluminum, based on the total weight of the alloy.

The process of this invention is useful for removing surface oxides from both tempered and untempered copper-base alloys. The process can clean both annealed-to-temper and rolled-to-temper alloy. In one embodiment of this invention, the process is particularly useful for removing the surface oxides from a copper-base alloy that was annealed to temper at a temperature in excess of 725° F.

Process Reagents

Solution of Potassium Ions:

Essentially any potassium compound that is at least slightly soluble in water can be used in the preparation of the solution with potassium hydroxide and the various potassium salts, such as buffered potassium phosphate, potassium bisulfate, potassium sulfite, potassium sulfate, etc., being representative.

The pH of the solution of potassium ions can vary widely and is dependent in part on the nature of the copper-base alloy to be cleaned. For untempered alloy or alloy that was either rolled-to-temper or annealed-to-temper at a temperature of less than 725° F., the pH of the solution of potassium ions can range from acidic (e.g. 1) to basic (e.g. 14). For an alloy that was annealed-to-temper at a temperature in excess of 725° F., the pH of the solution is generally between about 7 and 11, preferably between about 8 and less than 10. For basic solutions, potassium hydroxide is a preferred source of potassium ions while for acidic solutions, potassium bisulfate is a preferred source of potassium ions.

Solution of Acid-Peroxide-Metal Oxide:

The acid component of the solution is typically sulfuric acid but it can also be another mineral acid, such as nitric or hydrochloric acid, or an appropriate non-mineral acid, such as para-toluenesulphonic acid. Acid mixtures, such as a mixture of nitric and hydrochloric acid, can also be used as the acid component. The acid equivalent of this solution is preferably that of a sulfuric acid solution of about 9 to 18 percent by volume.

The peroxide component of this solution is typically hydrogen peroxide but other peroxides can also be used. Preferably the peroxide concentration is of about 4 to 6 percent by volume.

The metal oxide component of this solution is typically an acid or anhydride of a metal oxide, e.g. molybdic acid or molybdenum trioxide. The metal of the oxide has an atomic number of at least 23 (vanadium) and is preferably one of vanadium, niobium, tantalum, chromium, molybdenum, tungsten, manganese and rhenium. Molybdenum is an especially preferred metal atom of the oxide. The metal oxide can consist of one particular oxide, e.g. molybdic acid, or can be a mixture of two or more oxides, e.g. molybdic acid and tungstic acid. The preferred metal oxide concentration of this solution is between about 0.2 and 1 percent by volume.

Both the solution of potassium ions and the solution of acid-peroxide-metal oxide can be either neat or can contain various, compatible additives. For example, one or more stabilizers are frequently used in the solution of the second step to assist in maintaining the peroxide concentration. Other additives that can be used include buffers, solubilizing agents and conditioners (e.g. anti-stain agents).

Process Steps

The first step of this invention is to contact the surface of the copper-base alloy with a solution comprising potassium ions. Any mode of contacting can be employed but immersion of the surface in the solution or spraying the solution onto the surface of the alloy is most typical. The solution temperature can vary widely but typically ranges between 140° F. and the boiling point of the solution, perferably between about 160° F. and 180° F. The solution is in contact with the surface of the alloy for at least two seconds with practical considerations being the only limit on the maximum contact time. A typical contact time is between 15 and 75 seconds.

After the surface of the alloy has been contacted with the solution of potassium ions, it is optionally dried and/or rinsed prior to being contacted with the solution of acid-peroxide-metal oxide. If dried, the manner of drying can vary to convenience with the use of squeege rolls or blow-drying with air or some other suitable gas as representative of the more conventional techniques. If a rinse is used, the rinsing media is typically water which can optionally contain various additives. The temperature of the rinse water and the length of the contact time can vary to convenience. If a rinse step is used, then the surface of the alloy can subsequently be dried before being transferred to the next step.

The second step of this invention is contacting the surface of the copper-base alloy with the acid-peroxide-metal oxide solution. Here too, the manner of contacting, the temperature of the solution and the length of contact time can vary to convenience. Typically the surface of the alloy is immersed in the solution for at least two seconds, typically between 15 and 75 seconds, while the temperature of the solution is between 50° and 140° F., preferably between 70° and 100° F.

After the alloy has been contacted with the acid-peroxide-metal oxide solution, it is typically subjected to a water rinse (either hot or cold) and optionally treated with an anti-stain agent to retard room temperature oxidation.

In a typical application of this invention, the cleaning process of this invention is employed in the final steps of a copper-base alloy production line. The alloy is received from either a rolling or annealing operation and if received from a rolling operation, subjected to a degreasing step. The alloy, typically in the form of continuous sheet or wire, is then continuously fed into and through a solution of potassium ions. The alloy is continuously removed from the potassium salt solution, rinsed and continuously fed into and through the acid-peroxide-metal oxide solution. Finally the alloy is rinsed again, treated with an anti-stain agent, coiled and either packaged for shipping or passed onto a fabrication process. The residence or contact time of the alloy with the various solutions, including rinses, are similar.

The following examples are illustrative embodiments of this invention.

EXAMPLES

Copper-Base Alloy

Strips (4"×2") were cut from sheets (0.0075" thick) of copper-base alloy (containing 21.3–24.7 wt percent zinc, 3.3–3.5 wt percent aluminum, 0.5–0.7 wt percent nickel and the balance essentially copper) which were either rolled or annealed to temper. The surface oxides of each strip were identified and quantified by Auger Electron Spectroscopy. Since this analytical technique cannot be used quantitatively on an absolute scale, the results in the Table are reported as relative ratios. Initially, the surface of the samples are coated with oxides. After cleaning, the oxides are removed and the actual composition of the brass is exposed. Ratios were therefore taken of the aluminum and zinc peak intensities with respect to the copper before and after cleaning. It was observed that a thoroughly cleaned brass sample would show a final ratio of Al/Cu below 0.1. This value corresponds to the aluminum actually found in the bulk composition of the brass; therefore this is the baseline value that was used to determine the success of the cleaning method.

Cleaning Procedure

A strip of copper-base alloy was first cleaned with acetone to remove any surface dirt and/or grease. The strip was then immersed in a solution of potassium hydroxide (160° F.) for 60 seconds. The strip was then removed from the solution and rinsed with clear water (room temperature) and then immersed in an acid-peroxide-metal oxide solution (sulfuric acid of 15 percent by volume, hydrogen peroxide of 5 percent by volume, and molybdic acid of 1 percent by volume, 100° F.) for 60 seconds. The strip was then removed from the solution and again rinsed with clear water. The strip was then subjected to Auger spectroscopy.

TABLE

SURFACE OXIDE REMOVAL FROM COPPER-BASE ALLOY STRIPS

| Ex. | Tempering Procedure # & Temp. (°F.) | pH of K ion Solution | Before Cleaning Al/Cu | Before Cleaning Zn/Cu | After Cleaning Al/Cu | After Cleaning Zn/Cu |
|---|---|---|---|---|---|---|
| 1 | Rolled | 8 | 0.25 | 0.6 | 0.06 | 0.25 |
| 2 | Rolled | 8 | 0.46 | 0.5 | 0.05 | 0.25 |
| 3 | Rolled | 8 | 0.60 | 0.48 | 0.12 | 0.40 |
| 4 | Annealed-700 | 4* | 1.8 | 0.4 | 0.04 | 0.18 |
| 5 | Annealed-700 | 6* | 1.8 | 0.4 | 0.14 | 0.24 |

TABLE-continued

SURFACE OXIDE REMOVAL FROM COPPER-BASE ALLOY STRIPS

| Ex. | Tempering Procedure # & Temp. (°F.) | pH of K ion Solution | Before Cleaning Al/Cu | Before Cleaning Zn/Cu | After Cleaning Al/Cu | After Cleaning Zn/Cu |
|---|---|---|---|---|---|---|
| 6 | Annealed-700 | 8 | 1.8 | 0.4 | 0.04 | 0.21 |
| 7 | Annealed-700 | 11.5 | 1.8 | 0.4 | 0.08 | 0.29 |
| 8± | Annealed-500 | 8 | 0.15 | 1.15 | 0.07 | 0.27 |
| 9± | Annealed-900 | 8 | 3.20 | 0.65 | 0.16 | 0.23 |
| 10± | Annealed-1025 | 8 | 5.00 | 0.50 | 0.08 | 0.18 |

#Annealing atmosphere of dissociated $NH_3$ (2 percent hydrogen) for Examples 4–7 and 9–10 and of air for Example 8.

*$KHSO_4$ used as source of potassium ions rather than KOH.

±Temperature of KOH solution 190° F. rather than 160° F.

As the data in the above Table demonstrates, the process of this invention consistently removes surface oxides from both rolled- and annealed-to-temper copper-base alloys in a very efficient manner.

Although the invention has been described in detail by the preceding examples, this detail is for the purpose of illustration only and is not intended as a limitation upon the spirit and scope of the appended claims.

What is claimed is:

1. A process for removing surface oxides from a copper-base alloy, the process comprising:

(a) contacting the alloy surface with an aqueous solution comprising potassium ions; and (b) subsequently contacting the alloy surface with an aqueous solution comprising an acid, a peroxide, and a metal oxide where the metal of the oxide is molybdenum, the solution having:

(i) an acid equivalent of a sulfuric acid solution of about 4 to 30 percent by volume;

(ii) a peroxide concentration of about 1 to 30 percent by volume; and (iii) a metal oxide concentration of about 0.1 to 5 percent by volume

2. The process of claim 1 where the acid equivalent of the acid-peroxide-metal oxide solution is equivalent to a sulfuric acid solution of about 9 to about 18 percent by volume.

3. The process of claim 2 where the peroxide concentration of the acid-peroxide-metal oxide solution is between about 4 and 6 percent by volume.

4. The process of claim 3 where the metal oxide concentration of the acid-peroxide-metal oxide solution is between about 0.2 and 1 percent by volume.

5. The process of claim 4 where the pH of the aqueous solution containing potassium ions is between about 7 and 11.

6. The process of claim 4 where the pH of the aqueous solution containing potassium ions is between about 8 and less than 10.

7. The process of claim 4 where the source of potassium ions in the aqueous solution of step (a) is potassium hydroxide.

8. The process of claim 7 where the acid in the acid-peroxide-metal oxide solution is sulfuric acid and the peroxide in the acid-peroxide-metal oxide solution is hydrogen peroxide.

9. The process of claim 8 where the metal oxide in the acid-peroxide-metal oxide solution is at least one of molybdic acid and molybdenum trioxide.

10. The process of claims 1, 4, 7 or 9 where the temperature of the solution comprising potassium ions is between 140° F. and the boiling point of the solution and the temperature of the acid-peroxide-metal oxide solution is between about 50° F. and 110° F.

11. The process of claim 9 where the temperature of the solution comprising potassium ions is between about 160° F. and 180° F. and the temperature of the acid-peroxide-metal oxide solution is between about 70° F. and 100° F.

12. The process of claims 1, 4, 7, 9 or 11 where the copper-base alloy is contacted with the solution comprising potassium ions and the acid-peroxide-metal oxide solution for a period of time between about 15 and 75 seconds each.

13. The process of claims 1, 4, 7, 9 or 11 where the copper-base alloy contains between about 50 and 90 wt percent copper, between 1 and about 45 wt percent zinc, and between about 0.1 and about 15 wt percent aluminum, based on the total weight of the alloy.

14. The process of claim 13 where the copper-base alloy has been rolled-to-temper.

15. The process of claim 13 where the copper-base alloy has been annealed-to-temper.

16. The process of claim 13 where the copper-base alloy has been annealed-to-temper at a temperature in excess of 725° F.

17. A process for removing surface oxides from a copper-base alloy, the process comprising:

(a) contacting the alloy surface with an aqueous solution comprising potassium hydroxide having a pH between about 8 and less than about 10; and (b) subsequently contacting the alloy surface with an aqueous solution comprising sulfuric acid, hydrogen peroxide, and a molybdenum oxide, the solution having:

(i) a sulfuric acid concentration of about 9 to about 18 percent by volume;

(ii) a hydrogen peroxide concentration between about 4 and 6 percent by volume; and (iii) a molybdenum oxide concentration between about 0.2 and 1 percent by volume.

18. A process for removing surface oxides from a copper-base alloy, the process comprising:

(a) contacting the alloy surface with an aqueous solution comprising potassium hydroxide having a pH between about 8 and less than about 10; and (b) subsequently contacting the alloy surface with an aqueous solution comprising sulfuric acid, hydrogen peroxide, and at least one of molybdic acid and molybdenum trioxide, the solution having:

(i) a sulfuric acid concentration of about 9 to about 18 percent by volume;

(ii) a hydrogen peroxide concentration between about 4 and 6 percent by volume; and (iii) a molybdic acid and molybdenum trioxide concentration between about 0.2 and 1 percent by volume.

* * * * *